United States Patent [19]

Mocek, Jr. et al.

[11] 4,170,393

[45] Oct. 9, 1979

[54] ELECTRICAL CONNECTOR WITH REPLACEABLE CONTACTS

[75] Inventors: Aloysius M. Mocek, Jr.; George A. Oak, both of Toledo, Ohio

[73] Assignee: Power Industries Inc., Division of Groman Corporation, Toledo, Ohio

[21] Appl. No.: 851,161

[22] Filed: Nov. 14, 1977

[51] Int. Cl.[2] ..... H01R 13/42

[52] U.S. Cl. ..... 339/63 M; 339/192 R; 339/206 R; 339/218 M

[58] Field of Search ..... 339/31 R, 63 R, 63 M, 339/206 R, 206 P, 210 R, 210 M, 218 R, 218 M, 217 R, 217 PS, 217 TP, 191 R, 191 M, 192 R

[56] References Cited

U.S. PATENT DOCUMENTS

| | | | |
|---|---|---|---|
| 2,580,698 | 1/1952 | Perlman | 339/192 R |
| 2,716,737 | 8/1955 | Maberry | 339/31 R |
| 2,753,534 | 7/1956 | Sprigg | 339/191 M |
| 3,210,720 | 10/1956 | Harris, Jr. | 339/31 R |
| 3,718,887 | 2/1973 | Solomon et al. | 339/218 M |

*Primary Examiner*—Neil Abrams
*Attorney, Agent, or Firm*—Charles F. Schroeder

[57] ABSTRACT

An electrical cable connector of the multi-contact type wherein pin contact members of a male plug component engage and make electrical connection with corresponding spring finger contact members of a female receptacle, the pin and spring finger members each being threadably secured in a wire lead connecting base portion mounted in an insulating matrix in the plug and sockets components, respectively. The base portion for both the pin and spring finger members can be identical, thus providing a common base in a three piece contact system wherein a common base will receive either the male pin or the female spring finger members and allow ready removal of the contact members for replacement without disconnection of lead wires in instances of damage such as might be caused by dropping or rough handling of the connector.

12 Claims, 8 Drawing Figures

ELECTRICAL CONNECTOR WITH REPLACEABLE CONTACTS

This invention is related to electrical cable connectors of the multi-contact type in which pin contact members of a plug portion engage and make electrical connection with corresponding spring finger contact members of a receptacle portion, and more particularly to a connector in which the pin and spring finger contacts are threaded into base portions permitting them to be removed and replaced when necessary without need for disconnection of lead wires connnected to the contact members.

Multi-contact electrical connectors frequently incorporate a large number of mating contact members and require precision assembly and protection to a degree that the cost of such connectors is quite high. Such connectors are frequently found in use in locations such as reactor power stations, where reliability and minimum maintenance are highly important. When multi-contact connectors have either male pin contact members or the female spring finger members bent, dented, or crimped, such as by accidental dropping or misuse, it is frequently the practice and necessary with conventional connectors to replace the entire connector.

The contact members of such electrical connectors are usually located majorly within a molded matrix of insulating material with the active electrical contacting portions projecting from or accessible at the face of the components to be mated. Electrical leads crimped, soldered, or otherwise electrically connected to each of the contact members enter the rear of the respective components of the connector. Thus replacement of individual damaged contacts become a tedious, time-consuming chore and frequently an impossible task calling for replacement of the entire component or connector.

In view of the foregoing, it is an object of the present invention to provide a multi-contact connector system in which damaged pin contacts and spring finger contacts can be readily replaced without need for disconnecting lead wires from the connector.

It is another object of the invention to provide a simple, low-cost contact member system in which replacements can be made at a low-cost both from the standpoint of the labor of replacement and the parts involved.

According to the present invention, these objectives are attained by provision of contact members in which the active contact portions of each, either the pin or the spring finger, are threadably removable from their base portions without requiring that the base portions be removed from the connector component in which they are located or disconnecting the lead wires electrically connected thereto. Further, the loose portions from both the pin portion and the spring portion of the contact members can be identical, thereby making it possible to reduce the total number of required contact parts to three and making further reductions in contacts replacement cost possible.

Features of the invention are in both the ease of replacement of damaged contact members of multi-contact connectors and the low cost of replacement.

Another feature is the rapidity with which contact members can be replaced thereby promoting reduced down time for repair of operating equipment.

Other objects and features which are believed to be characteristic of my invention are set forth with particularity in the appended claims. My invention, however, both in organization and manner of construction, together with further objects and features thereof may be best understood by reference to the following description taken in connection with the accompanying drawings in which:

Figure 1:
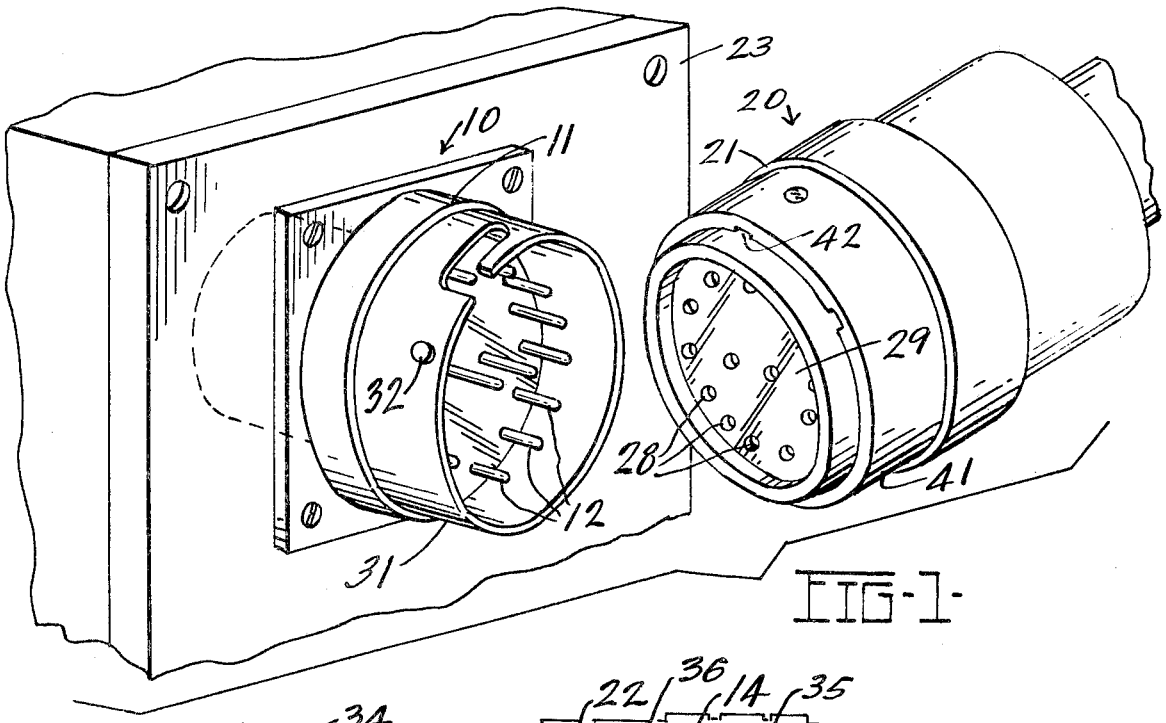
FIG. 1 illustrates in perspective a multi-contact connector shown with its male plug and female socket components separated ready for connection.

Turning to the drawings in greater detail, FIG. 1 shows a multi-contact connector of the type adaptable to embodying the present invention wherein a mateable plug 10 and a socket 20 are provided with mateable housings 11 and 21 respectively, preferably made of relatively non-corrosive material such as aluminum or stainless steel. The plug 10, although capable of being in the form of a self-sustained component is shown mounted on a connection box 23 in a position where it can be mated with the socket 20.

Mating of the two components can be effected by pushing the socket into communication with the plug 10 with the pin contacts 12 making engagement with correspondingly arranged apertures 28 in the face 29 of the socket. The plug is provided with an annular receptacle shell 31 having coupling projections 32 spaced about its outer periphery which make engagement with coupling grooves 42 in a rotatable coupling collar 41 on the socket 20. After being pressed into abutting relation, the plug and socket can be coupled in locked relation by rotating the coupling collar 41 to engage the coupling projection 32 in locking grooves (not shown) on the interior of the coupling collar and extending in a generally circumferential direction from the coupling grooves 42.

Figure 2:
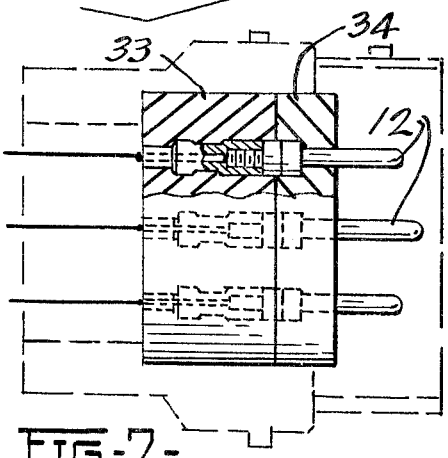
FIG. 2 shows in a partially broken away, dashed line and cross-sectioned view the plug component of the connector of FIG. 1 illustrating the pin contact portions of its contact members threadably mounted in their base portions.
Figure 3:
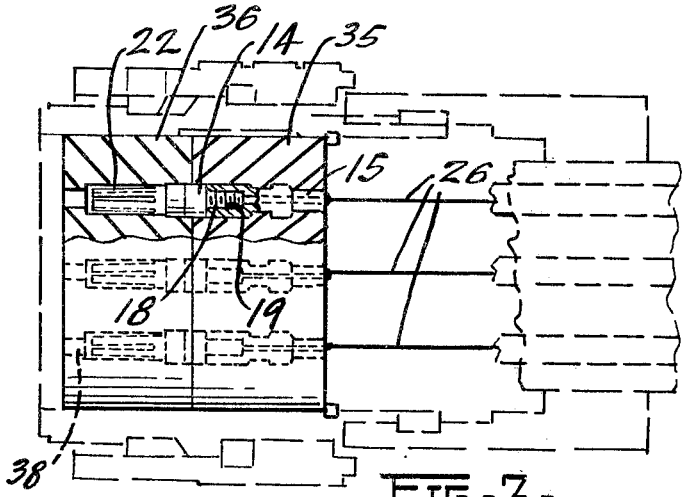
FIG. 3 shows in a partially broken away, dashed line and cross-sectioned view the socket component of the connector of FIG. 1 illustrating the arrangement of the spring finger contact portions of its contact members threadably mounted in their base portions.
Figure 4:
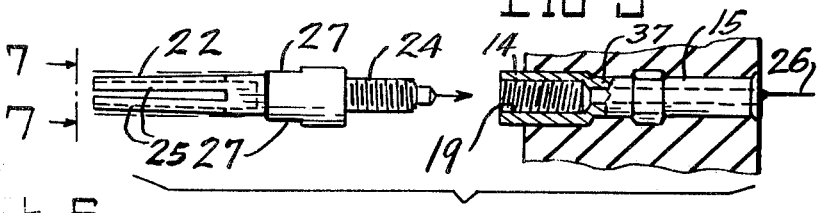
FIG. 4 illustrates partly in cross-section a spring finger contact separated from its base portion which is shown supported in an elastomer matrix present in the socket housing.
Figure 5:
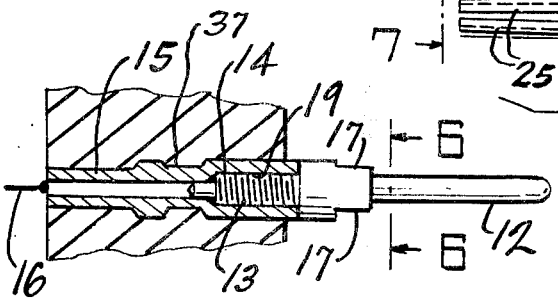
FIG. 5 illustrates partly in cross-section a pin contact mounted on its base portion which is shown supported in an elastomeric matrix present in the plug housing.

FIGS. 2 and 3 show in cross-section and in dashed lines the arrangement of parts in the plug 10 and socket 20, respectively. The plug is provided with two abutting circular inserts 33 and 34. Each is molded of elastomeric material such as silicone rubber. They have the property of being slightly yieldable, permitting removeable insertion in tight fit relation in the plug housing 11 and allowing it to act as a self-adjusting matrix for holding the pin contact members. The pin contact members are each made of two parts, a longitudinal pin contact 12 threadably secured on a base 14 as shown in greater detail in FIGS. 5 and 6. The pin contact members are substantially fully embedded in close fit channels extending in aligned relation through both the rear and front inserts 33 and 34, respectively.

The contact base portion 14 has an internally threaded bore or barrel portion 19 at its forward end and a lead wire receiving crimp barrel portion 15 at its rear end into which an electrical lead wire 16 is shown connected such as by soldered or crimped therein. The base 14 is mounted in the matrix insert 33 with its forward end protruding slightly forward from the face of the insert. Tool flats 37 on opposite sides of and extending for at least a portion of the length of the threaded barrel portion 19 serve to hold the base portion against rotation when a pin contact 12 is threaded in electric communicating relation into the threaded portion 19. The pin contact 12 also has a section of tool flats 17 on opposing sides near its base end behind its contact prong which permits grasp of the contact with a tool such as a wrench to permit tightening of its threaded end 13 into the threaded portion 19 of its base 14. The front plug insert 34 fits over the pin contacts and conceals and protects the mated portions of the pin contacts 12 on their bases 14 against extraneous matter and moisture while at the same time providing support for the pin contacts against misalignment.

The socket 20, as can be seen in FIG. 3, is also provided with a pair of mated inserts, one in front and one in the rear in side-by-side abutting relation. The rear insert 35 is of material having a slight yield such as silicone rubber and is removeably inserted and held in tight fit relation in the socket housing 21. The front insert 36 shown in FIG. 8 which provides the face 29 of the socket is made of harder and more protective material such as phenolic resin. The socket spring finger contact members are held within channels 38 extending in aligned relation through the two abutting inserts. Each spring finger contact member is made up of two threaded together parts; namely, a longitudinal spring finger contact 22 and a base 14 identical to that of the pin contact members. In the socket 20, the bases 14 are mounted in the matrix insert 35 in a manner similar to that in which the bases are mounted in the plug 10 with their forward ends protruding slightly forward from the face of the rear insert 35. Lead wires 26 are electrically connected to the wire receiving barrel ends 15 of the bases 14 which are substantially fully embedded in the matrix 35.

Figure 6:
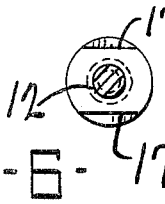
FIG. 6 is a partially cross-sectioned front view of the pin contact as taken on line 6—6 of FIG. 5.
Figure 7:
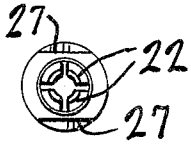
FIG. 7 is a front view of the spring finger contact of FIG. 4.
Figure 8:
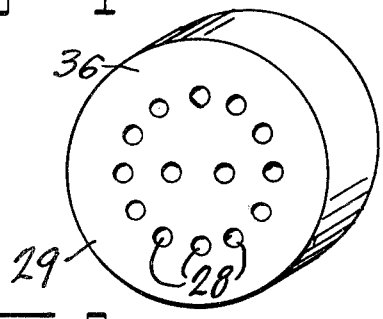
FIG. 8 is a perspective view of insert in the socket housing of FIG. 3 forming the face of the socket in which the spring fingers are protectively housed.

The spring finger contacts 22 are each provided with a male threaded portion 24 for threadable combination and electrical connection on the base 14. Two or more spring fingers 25, such as four fingers as shown in FIG. 7, are aligned longitudinally and circumferentially about the axis of the contact 22 for receipt of a prong of a plug pin contact 12 in spring biased electrically connected relation. Tool flats 27, as may be seen in FIG. 6, are provided on opposite sides of the contact 22 just behind the spring fingers 25 to permit engagement with a tool to permit tightening of its threaded portion 24 into the threaded portion 19 of its base 14. The front insert 36 shown in FIG. 8 is made of harder material than the rear insert 35 in order to provide greater protection for the spring fingers in their matrix channels 38 against exposure and abuse from external forces.

The spring fingers are made of durable high electrical conductivity spring metal such as beryllium copper while the base 14 and the pin contacts 12 are made of durable high electrical conductivity metal such as copper or brass.

In view of the foregoing it will be understood that many variations of the arrangement of my invention fall within the broad scope of the principles embodied therein. For example, under certain conditions it might be found desirable to make the threaded portion of the contacts female threads within a barrel and the base provided with male threads, rather than vice versa as shown and described. Still further, the plug might be provided with some female spring finger members and the socket provided with the mating contacts. Thus, while a particular preferred embodiment of my invention has been shown and described, it is intended by the appended claims to cover all such modifications which fall within the true spirit and scope of the invention.

I claim:

1. An electrical connector comprising a housing of rigid protective material having an open face portion, a yieldable matrix material protectively contained within said housing, a plurality of current carrying contact members extending partially within and extending from said matrix material comprising active electrical contact portions accessible at said face portion, and corresponding base portions supported at least in part in and by said elastomeric matrix material and projecting slightly from said matrix material and on which said active contact portions are threadably secured.

2. An electrical connector as set out in claim 1 wherein said contact members have lead wires connected thereto by electrical connection directly to their respective base portions.

3. An electrical connector according to claim 2 comprising a male plug component wherein the contact members include pin contacts projecting from said face portion.

4. An electrical connector according to claim 2 comprising a female socket component wherein the contact members include spring finger contacts.

5. An electrical connector according to claim 4 wherein the spring finger contacts are protectively residenced in aperture channels through an electrically non-conductive insert of hard material retained in aligned relation by said housing on the face side of said elastomeric matrix material.

6. An electrical connector according to claim 4 wherein the base portion of said connector members are of copper and said spring finger contacts comprise beryllium copper.

7. An electrical connector formed of two mateable components, one said component comprising a plug and the other a socket, each of said components comprising a housing of rigid protective material having an open face portion, a yieldable elastomeric matrix material protectively contained as an insert within said housing, a plurality of current conducting contact members extending partially within and from said matrix material comprising active electrical contact portions accessible at said face portion, and corresponding identical base portions supported in part in and by said matrix material and projecting slightly from said matrix material and on which said active contact portions are removeably secured.

8. An electrical connector as set out in claim 7 wherein each of said connector components have lead wires of a cable electrically connected to contact members thereof, said lead wires being connected directly to the base portions of said members, thereby permitting removal and replacement of active contact portions of said contact members without disconnection of said connected lead wires.

9. An electrical connector as set out in claim 8 wherein the plug component incorporates contact members comprising pin contacts threadably secured to base portions, said pin contacts projecting from the face portion of said plug.

10. An electrical connector as set out in claim 8 wherein the socket component incorporates contact members comprising spring finger contacts threadably secured to base portions, said spring finger contacts being protectively residenced in aperture channels in material in the form of an insert retained in aligned relation by said housing and forming the face of said socket component.

11. An electrical connector as set out in claim 10 wherein the material forming the face of the socket component is substantially harder than said elastomeric material.

12. An electrical connector as set out in claim 10 wherein the base portions of said connector members are made of copper or brass and said spring finger contacts comprise beryllium copper.

* * * * *